US006942136B2

(12) United States Patent
Tsai

(10) Patent No.: US 6,942,136 B2
(45) Date of Patent: Sep. 13, 2005

(54) STAPLER APPARATUS TO STAPLE STACKS OF PAPER WITH DIFFERENT THICKNESSES

(75) Inventor: Eric Tsai, Ta-Li (TW)

(73) Assignee: Apex Mfg. Co., Ltd., Tali (TW)

( * ) Notice: Subject to any disclaimer, the term of this patent is extended or adjusted under 35 U.S.C. 154(b) by 0 days.

(21) Appl. No.: 10/689,045

(22) Filed: Oct. 21, 2003

(65) Prior Publication Data

US 2005/0082335 A1 Apr. 21, 2005

(51) Int. Cl.[7] ..... B25C 5/02

(52) U.S. Cl. ..... 227/155; 227/156; 227/120

(58) Field of Search ..... 227/130, 155, 227/156, 120

(56) References Cited

U.S. PATENT DOCUMENTS 5,516,025 A * 5/1996 Eriksson ..... 227/155
5,758,813 A * 6/1998 Kikuchi et al. ..... 227/155
6,036,074 A * 3/2000 Manabe ..... 227/155
6,250,531 B1 * 6/2001 Yagi ..... 227/155

* cited by examiner

*Primary Examiner*—John Sipos
*Assistant Examiner*—Michelle Lopez
(74) *Attorney, Agent, or Firm*—Bacon & Thomas, PLLC

(57) ABSTRACT

A staple apparatus is installed in a stapler so the stapler can staple stacks of paper with different thicknesses without having to change staples or components in the stapler. The apparatus cuts legs of a staple to a proper length after the staple has been driven completely into a stack of paper and bends the protruding ends to bind the stack of paper together. The apparatus performs these operations with a cutter, a bending template, and a cutting anvil in conjunction with a sliding bracket and a cutter actuator. Operation of the cutter is delayed by a staple driver actuator until the staple has completely penetrated the stack of paper.

6 Claims, 7 Drawing Sheets

STAPLER APPARATUS TO STAPLE STACKS OF PAPER WITH DIFFERENT THICKNESSES

BACKGROUND OF THE INVENTION

1. Field of the Invention

The present invention relates to a stapler, and more particularly to a stapler that has an apparatus to staple stacks of paper with different thicknesses without changing staples in the stapler.

2. Description of Related Art

Staplers use staples that are typically U-shaped and have two pointed legs to fasten pieces of paper together. The pointed legs of a staple are forced through the pieces of the paper, extend out of the pieces of paper and are bent to hold the pieces of paper together.

A common problem of most staplers is having correct size staples to staple a stack of paper together. A heavy-duty stapler uses staples with long legs that are only suitable for stapling a thick stack of paper together. Furthermore, the staples in a heavy-duty stapler cannot be used effectively to staple a thin stack of paper together, because the pointed legs of the staples for the heavy-duty stapler are so long that they wrap around and protrude from the top surface of the stack. The protruding legs constitute a hazard to a person handling the stapled stacks. If the pointed legs of the staple are shorter than the thickness of the stack of paper, the staple will not penetrate the stack and hold the sheets together.

Therefore, different sizes of staplers must be used to staple stacks of paper with different thicknesses. Before stapling a stack of paper, a person should be aware of the size of staples in the stapler. Therefore, a stand-alone stapler that uses a specific size of staples only meets a small range of stapling needs. Furthermore, having to have many stand-alone staplers to staple stacks of paper with different thicknesses is not economical.

To overcome the shortcomings, the present invention provides an apparatus for a stapler to mitigate or obviate the aforementioned problems.

SUMMARY OF THE INVENTION

The main objective of the invention is to provide an apparatus for a stapler so that the stapler can staple stacks of paper with different thicknesses without changing staples in the stapler.

The apparatus in accordance with the present invention is installed in a conventional stapler so the stapler can staple stacks of paper with different thicknesses without having to change staples or components in the stapler. The apparatus cuts legs of a staple to a proper length after the staple has been driven completely into a stack of paper and bends the protruding ends to bind the stack of paper together. The apparatus performs these operations with a cutter, a bending template, and a cutting anvil in conjunction with a sliding bracket and a cutter actuator. Operation of the cutter is delayed by a staple driver actuator until the staple has completely penetrated the stack of paper.

Other objectives, advantages and novel features of the invention will become more apparent from the following detailed description when taken in conjunction with the accompanying drawings.

DETAILED DESCRIPTION OF PREFERRED EMBODIMENT

Figure 1:
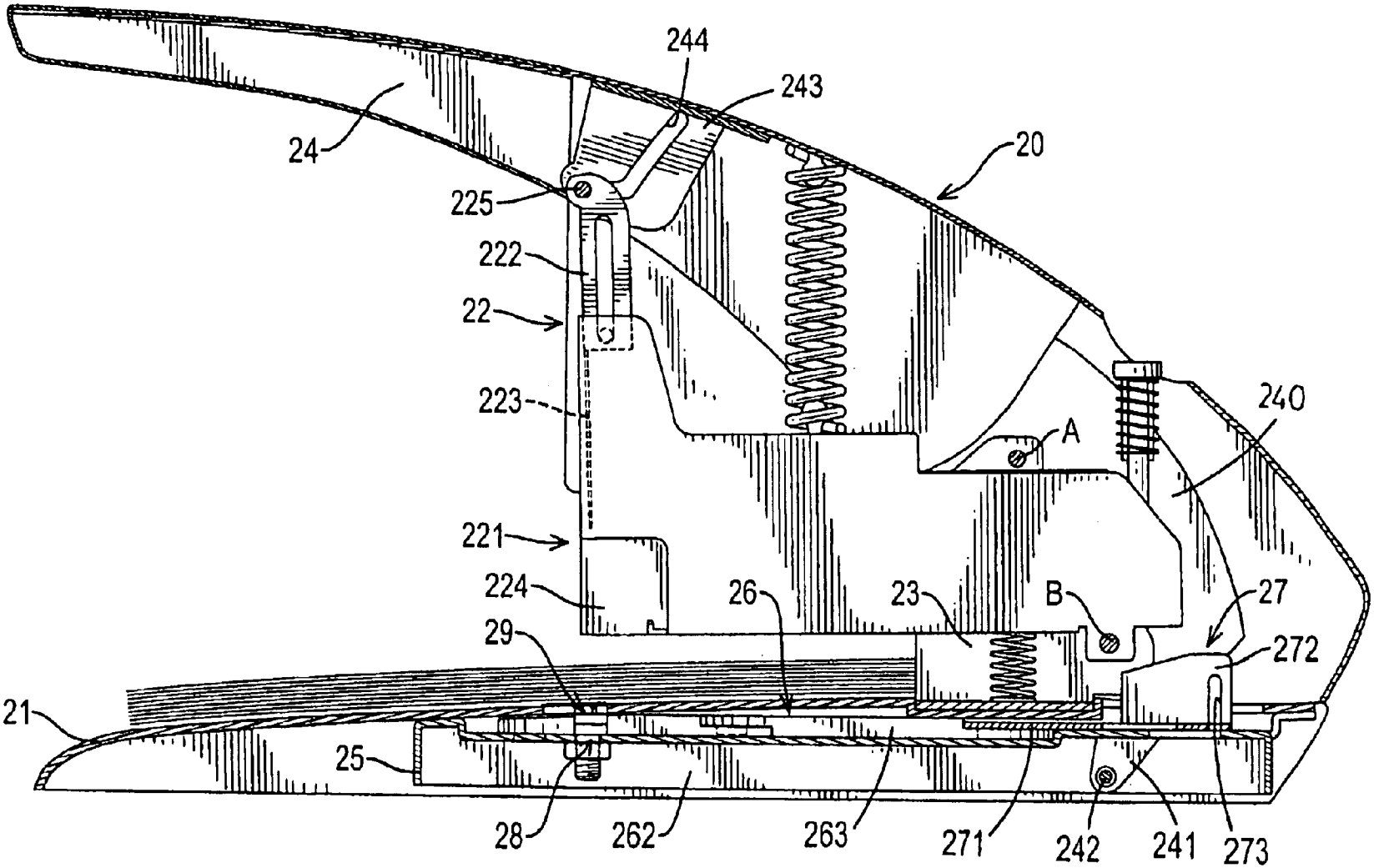
FIG. 1 is a side plan view in partial section of a stapler with an apparatus in accordance with the present invention.
Figure 2:
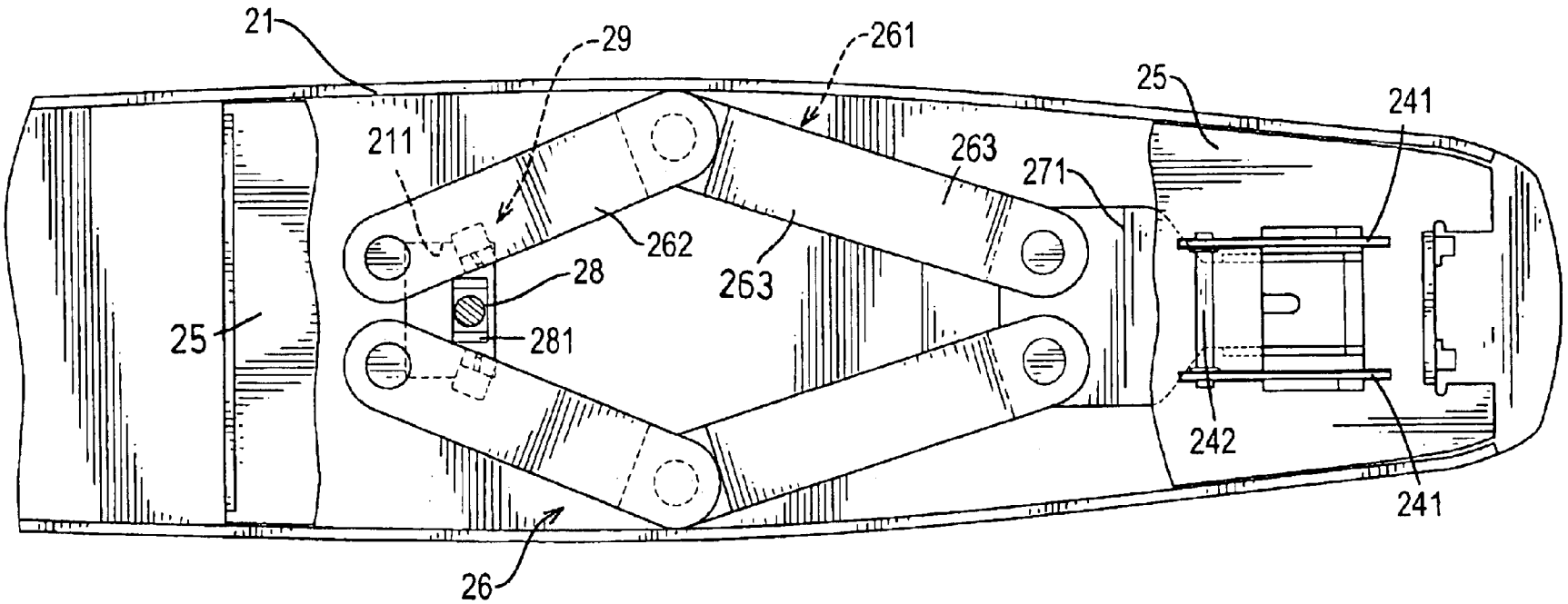
FIG. 2 is an enlarged bottom plan view of a cutter in the apparatus in the stapler in FIG. 1.
Figure 3:
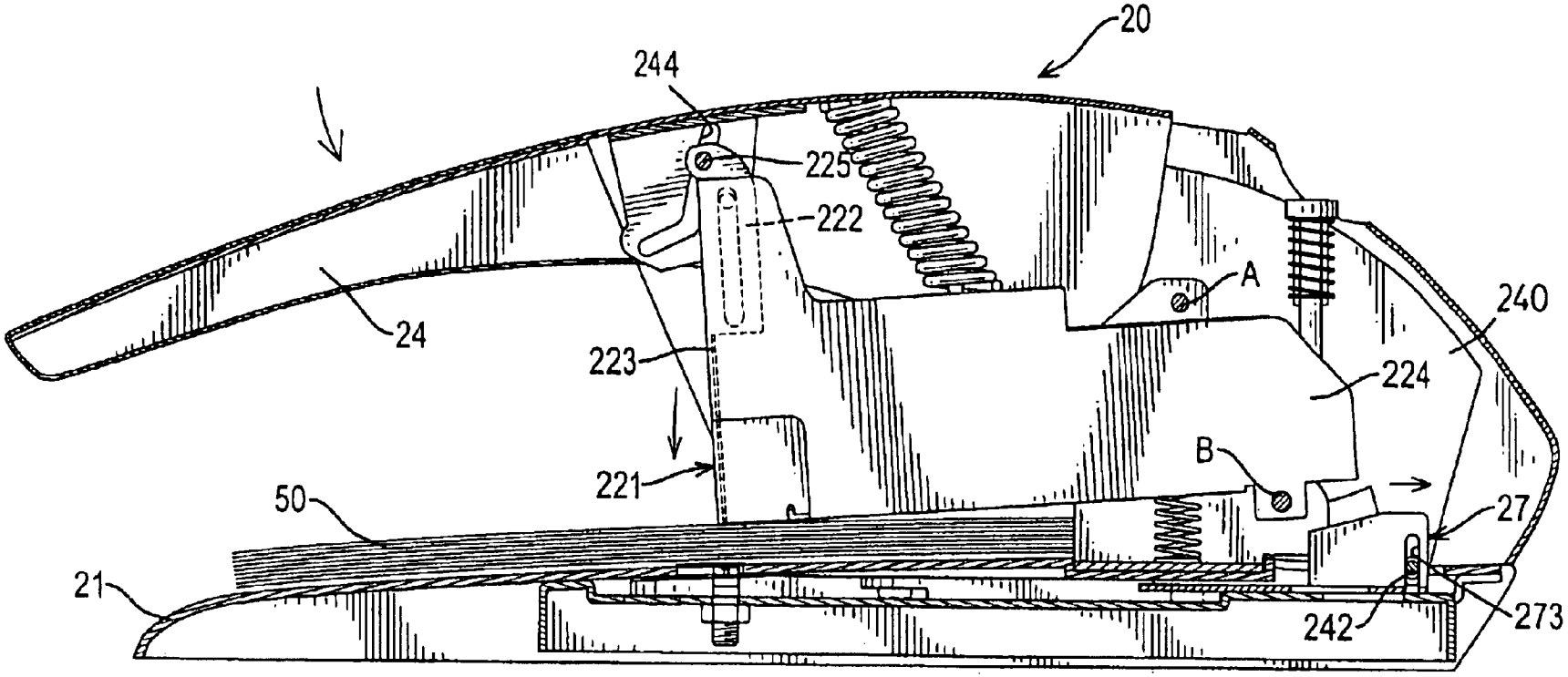
FIG. 3 is an operational, side plan view in partial section of the stapler in FIG. 1 when a stack of paper is stapled.

With reference to FIGS. 1 and 2, an apparatus for stapling stacks of paper with different thicknesses in accordance with the present invention is mounted in a conventional stapler (20). The stapler (20) comprises a base (21), a stapling mechanism (22), a mounting bracket (23) and a lever (24). The base (21) is hollow and has a top (not numbered), a cavity (not numbered) and a staple opening (211). The staple opening (211) is defined through the top and communicates with the cavity.

The mounting bracket (23) is substantially U-shaped, is attached to the top of the base (21) and has a magazine pivot point (B) and a lever pivot point (A). The lever pivot point (A) is formed above the magazine pivot point (B).

The stapling mechanism (22) is attached pivotally to the mounting bracket (23) at the magazine pivot joint (B) and comprises a magazine assembly (221), a staple driver guide (222), a staple driver (223) and a staple driver actuator (243).

The magazine assembly (221) is conventional and comprises a magazine (224) to hold staples (not shown). The magazine (224) has a front end (not numbered) and a rear end (not numbered). The rear end is pivotally attached to the mounting bracket (23) at the magazine pivot joint (B).

The staple driver guide (222) connects to the staple driver (223) that is slidably mounted in the magazine (224) at the front end. The staple driver guide (222) has an outer end (nor numbered) and a driving pin (225). The driving pin (225) is mounted transversally through the outer end.

The lever (24) is attached pivotally to the mounting bracket (23) at the lever pivot joint (A) and has a distal end (not numbered) and a proximal end (not numbered). The staple driver actuator (243) is mounted on the lever (24) over the staple driver guide (222) and has two rigid wings (not numbered) and two L-shaped slots (244). The rigid wings extend down from the lever (24). The L-shaped slots (244) respectively have a horizontal leg (not numbered) and a tangential leg (not numbered) and are transversely aligned and are formed respectively in the wings to slidably hold and drive the driving pin (225) in the staple driver guide (222).

The apparatus for stapling stacks of paper with different thicknesses comprises an inner base (25), a cutter actuator (240), a cutter (26), a sliding bracket (27) and a cutting anvil (28).

The inner base (25) is mounted in the cavity in the base (21) and has a top (not numbered). The cutter actuator (240)

is mounted or integrally formed on the proximal end of the lever (24) and comprises two parallel wings (241) and an actuating pin (242). The parallel winds (241) are attached to or formed integrally on the proximal end of the lever (24) and extend into the base (21) and the inner base (25). The actuating pin (242) is attached transversally between the parallel wings (241).

The cutter (26) is mounted in the cavity in the base (21) between the base (21) and the inner base (25) and comprises two articulated arms (261) and two bending templates (29). Each of the articulated arms (261) has a distal end (not numbered) and a proximal end (not numbered) and comprises a pivoting arm (262) and a movable arm (263) that are pivotally joined together. The proximal ends are pivotally attached to the top of the inner base (25) and between the base (21) and the inner base (25) adjacent to the staple opening (211).

The sliding bracket (27) is slidably mounted on the top of the inner base (25) and comprises a sliding base (271), a vertical wing (272) and an actuating slot (273). The sliding base (271) is slidably mounted on the top of the inner base (25) between the inner base (25) and the base (10) and has a tongue (not numbered) extending toward and pivotally connected to the distal ends of the articulated arms (261). The vertical wing (272) is symmetrically formed on and extends up from the sliding base (271). The actuating slot (273) is formed in the vertical wing (272) and extends up from the sliding base (271).

When the distal end of the lever (24) is pressed down, the driving pin (225) slides into the tangential legs in the L-shaped slots (244) in the staple driver actuator (243). As the driving pin (225) slides into the tangential legs, the actuating pin (242) in the cutter actuator (240) is pivoted around the lever pivot joint (A) and engages the actuating slot (273). As the driving pin (225) slides further into the tangential legs of the L-shaped slots (244), the circular motion of the actuating pin (242) pushes the actuating bracket (27) away from the articulated arms (261). As the distal ends of the articulated arms (261) are drawn away from the proximal ends of the articulated arms (261), the articulated arms (261) are drawn together.

The cutting anvil (28) is mounted on the top of the inner base (25) underneath the staple opening (211) and has a top (not numbered) and two opposite side cutting edges (281).

Figure 8:
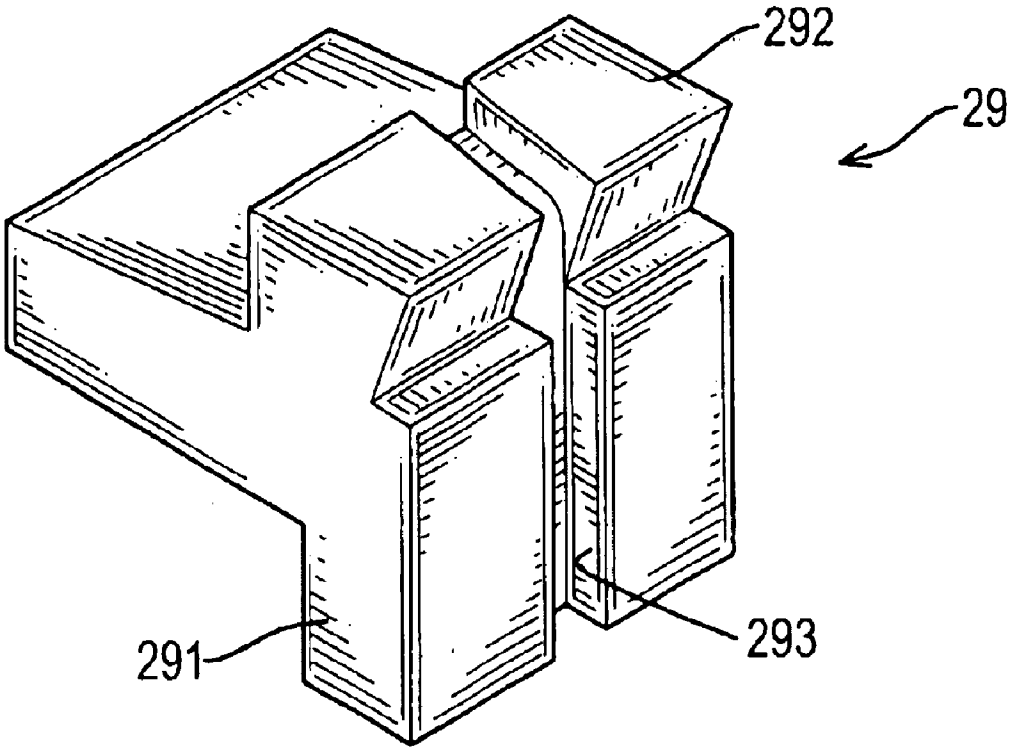
FIG. 8 is a perspective view of a bending template of the cutter in FIG. 5.

The bending templates (29) are mounted respectively on the pivoting arms (262) of the articulated arms (261) and are aligned respectively with the side cutting edges (281) of the cutting anvil (28). With further reference to FIG. 8, each of the bending templates (29) has a top (not numbered), a bottom protrusion (291), a top protrusion (292), an inside face (not numbered) and a bending slot (293). The bottom protrusion (291) has a bottom (not numbered). The top protrusion (292) is formed on the top and has a top surface (not numbered). The bottoms of the bottom protrusions (291) are level with the top of the cutting anvil (28) so the bottom protrusions (291) in co-operation with the side cutting edges (281) shear off excess length from the legs of the staple protruding through a stack of paper when the articulated arms (261) move together. The bending slot (293) is defined vertically in the inside face of the top and the bottom protrusions (292, 291) and in the top surface of the top protrusion (292). The bending slot (293) in the top surface of the top protrusion (292) may be formed at an acute angle relative to the inside face so bent legs of a staple will angle away from each other.

With reference to FIGS. 1 to 6, the apparatus for stapling stacks of paper with different thicknesses operates with a conventional stapler (20) will staple a stack of paper (50) of virtually any thickness with a U-shaped staple (51). The staple (51) has two pointed legs (not numbered) and a transverse top (not numbered) between the pointed legs. The pointed legs are long enough to penetrate and clamp any stack of paper (50). To operate the apparatus, the distal end of the lever (24) of the stapler (20) is pressed down. The horizontal legs of the L-shaped slots (244) in the staple driver actuator (243) press the driving pin (225), the staple driver guide (222) and the staple driver (223) down until the staple driver (223) abuts the staples (not shown) in the magazine (224). The stapling mechanism (22) pivots around the magazine pivot point (B) until the stapling mechanism (22) abuts the stack of paper (50). Continuing to press the lever (24) will force a staple (51) through the stack of paper (50) until the transverse top of the staple (51) abuts the stack of paper (50).

Figure 4:
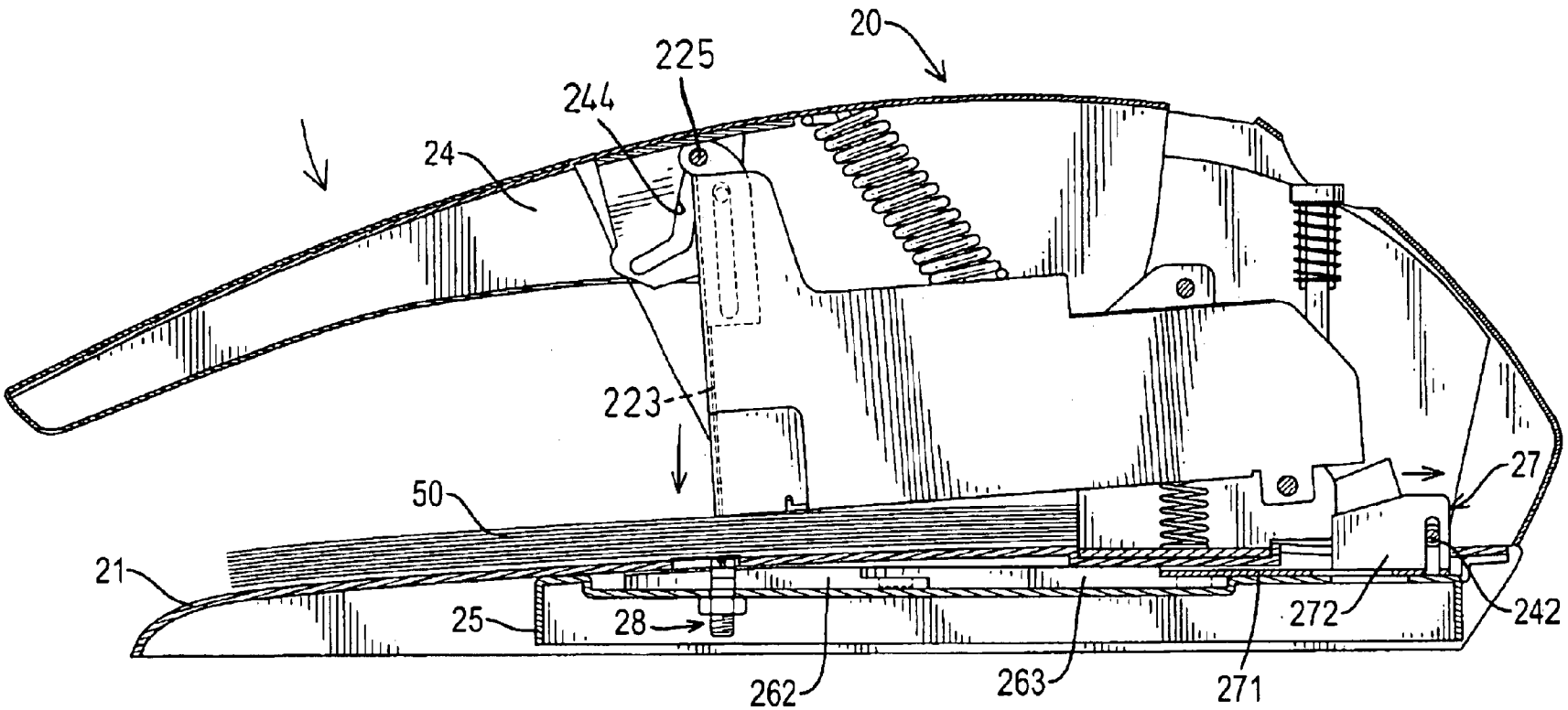
FIG. 4 is an operational, side plan view in partial section of the stapler in FIG. 3 when the staple arms are bent.
Figure 5:
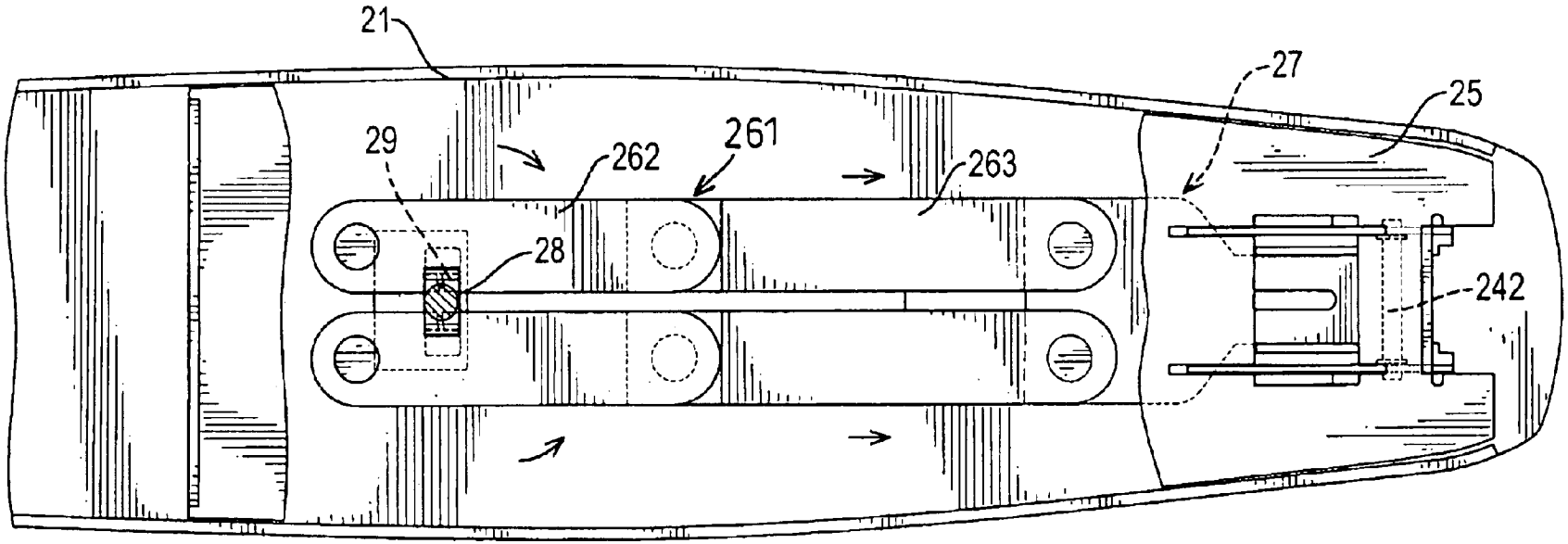
FIG. 5 is an enlarged operational bottom plan view of the cutter in FIG. 2 when the lever is pressed to bend the staple arms.
Figure 7:
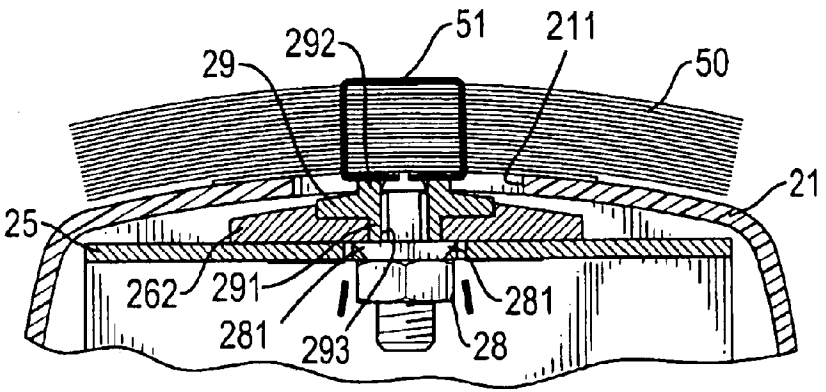
FIG. 7 is an enlarged operational front plan view in partial section of the cutter of the staple in FIG. 6 after the legs of the staple has been cut and bent to the stack of paper together.
Figure 6:
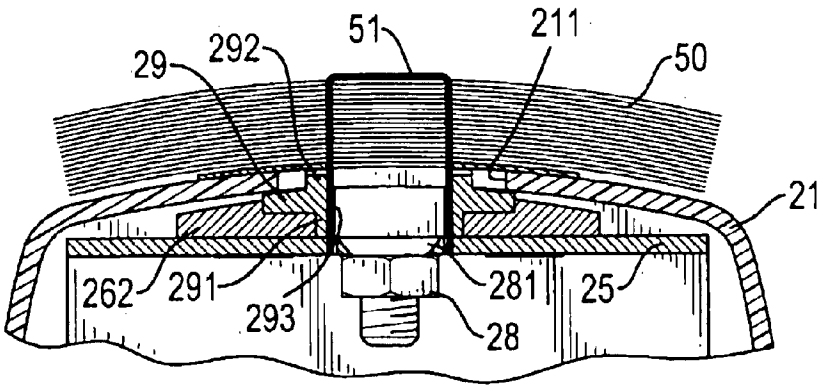
FIG. 6 is an enlarged operational front plan view in partial section of the cutter in the stapler FIG. 1 after a staple has been forced through the stack of paper.

With reference to FIGS. 4, 5 and 7, when the transverse top of the staple (51) abutting the top of the stack of paper (50), the pointed legs of the staple (51) extend into the base (21) through the staple opening (211). When the transverse top of the staple (51) abuts the stack of paper (50), the driving pin (225) moves out of the horizontal legs into the tangential legs of the L-shaped slot (244). As the driving pin (225) moves further into the tangential legs of the L-shaped slots (244), the actuating pin (242) of the cutter actuator (240) moves toward and engages the actuating slot (273) of the sliding bracket (27). Continuing to press the distal end of the lever (24) causes the actuating pin (242) to draw the sliding bracket (27) out and the articulated arms (261) of the cutter (26) together. The pointed legs of the staple (51) extending through the stack of paper (50) are sheared off to the right length respectively between the side cutting edges (281) of the cutting anvil (28) and the bending templates (29). Meanwhile, the actuating pin (242) slides into the actuating slot (273) in the sliding bracket (27) because of its circular motion caused by the pivoted lever (24).

Consequently, the apparatus allows a stapler (20) to smoothly staple a stack of paper (50) of any thickness without changing the size of the staple (51) in the stapler (20). The long pointed legs of the staples (51) will be cut to a correct length depending on the thickness of the stack of paper (50). The pointed legs extending beyond the stack of paper (50) are bent to fasten the sheet stack (50) together. The stapler (20) with the apparatus in accordance with the present invention can be used to staple a stack of paper (50) of any thickness. The apparatus makes multiple staplers (20) unnecessary. Therefore, money is saved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A staple apparatus to staple stacks of paper of different thickness for a stapler having a base with a cavity and a staple opening, a mounting bracket attached to the base, a stapling mechanism with a staple driver guide and a lever with a proximal end and a distal end pivotally mounted on the mounting bracket and the apparatus comprising:

an inner base having a top and adapted to be mounted in the cavity in the base;

a sliding bracket mounted slidably on the top of the inner base;

a cutting anvil mounted on the top of the inner base, adapted to be located below the stapling opening and having a top and two opposite side cutting edges;

a cutter mounted on the top of the inner base and the cutter comprising two articulated arms mounted on the top of the inner base, each of the articulated arms having a distal end pivotally connected to the sliding bracket and a proximal end pivotally attached to the top of the inner base; and two bending templates mounted respectively on the articulated arms and aligned with the cuffing anvil, each of the bending templates having a top, a bottom protrusion with a bottom, a top protrusion formed on the top and having a top surface, an inside face and a bending slot defined vertically in the inside face of the top and the bottom protrusions and the top surface of the top protrusion, and the bottom of each of the bottom protrusions being level with the top of the cutting anvil; and a cutter actuator adapted to be mounted on the distal end of the lever;

wherein the bottom protrusions of the bending templates are respectively moved by the articulated arms to shear excess length off the pointed legs of the staple by the side cutting edges as the articulated arms approach each other, and the top protrusions of the bending templates bend respectively the uncut pointed legs of the staple.

2. The staple apparatus as claimed in claim 1, wherein the sliding bracket comprises a sliding base slidably mounted on the top of the inner base and a vertical wing with an actuating slot extending upward from the sliding base; and the cutter actuator comprises two wings adapted to be formed integrally on the proximal end of the lever and extend respectively into the inner base, and an actuating pin attached transversally between the wings.

3. The staple apparatus as claimed in claim 1, wherein each of the articulated arms comprises a pivoting arm and a movable arm that are pivotally joined together, and the bending templates are mounted respectively on the pivoting arms and aligned respectively with the side cutting edges of the cutting anvil.

4. The staple apparatus as claimed in claim 2, wherein each of the articulated arms comprises a pivoting arm and a movable arm that are pivotally joined together, and the bending templates are mounted respectively on the pivoting arms and aligned respectively with the side cutting edges of the cutting anvil.

5. The staple apparatus as claimed in claim 3, wherein the bending slot in the top surface of the top protrusion of each of the bending templates is formed at an acute angle relative to the inside face.

6. The staple apparatus as claimed in claim 4, wherein the bending slot in the top surface of the top protrusion of each of the bending templates is formed at an acute angle relative to the inside face.

* * * * *